US009114298B2

(12) United States Patent
Ruggiero et al.

(10) Patent No.: US 9,114,298 B2
(45) Date of Patent: Aug. 25, 2015

(54) PUNCHING BAG AND SUSPENSION SYSTEM

(71) Applicants: Robert P. Ruggiero, Brooklyn, NY (US); Robert J. Johnson, Manalapan, NJ (US); Kelly S. Richardson, Forest Hills, NY (US)

(72) Inventors: Robert P. Ruggiero, Brooklyn, NY (US); Robert J. Johnson, Manalapan, NJ (US); Kelly S. Richardson, Forest Hills, NY (US)

( * ) Notice: Subject to any disclaimer, the term of this patent is extended or adjusted under 35 U.S.C. 154(b) by 93 days.

(21) Appl. No.: 13/797,691

(22) Filed: Mar. 12, 2013

(65) Prior Publication Data

US 2014/0274587 A1 Sep. 18, 2014

(51) Int. Cl.

| | |
|---|---|
| ***A63B 69/22*** | (2006.01) |
| ***A63B 69/24*** | (2006.01) |
| ***A63B 69/20*** | (2006.01) |
| ***A63B 69/00*** | (2006.01) |
| ***A63B 43/00*** | (2006.01) |

(52) U.S. Cl.

CPC ..... *A63B 69/206* (2013.01); *A63B 43/007* (2013.01); *A63B 69/0084* (2013.01)

(58) Field of Classification Search

CPC ..... A63B 69/20; A63B 69/24; A63B 69/203; A63B 69/205; A63B 69/206

USPC ..... 482/83–90, 44–50, 92, 110, 148; 446/129, 131–135, 137, 138, 489, 491

See application file for complete search history.

(56) References Cited

U.S. PATENT DOCUMENTS

| | | | | |
|---|---|---|---|---|
| 318,766 | A | 5/1885 | Longden | |
| 426,944 | A | 4/1890 | Lovatt | |
| 847,066 | A * | 3/1907 | Hall | 446/137 |
| 861,506 | A | 7/1907 | Doyle | |
| 1,991,848 | A * | 2/1935 | Embree | 5/1 |
| 2,247,072 | A | 6/1941 | Stow | |
| 2,772,882 | A * | 12/1956 | Anson | 473/429 |
| 3,545,121 | A | 12/1970 | Misko | |
| 3,558,134 | A | 1/1971 | Hoitsma | |
| 3,731,929 | A * | 5/1973 | Landry | 473/576 |
| 3,893,256 | A * | 7/1975 | Wolf et al. | 446/228 |
| 3,924,855 | A * | 12/1975 | Pretorius | 473/575 |
| 4,027,880 | A * | 6/1977 | Hadtke | 473/426 |
| 4,046,379 | A * | 9/1977 | Chase | 273/109 |

(Continued)

FOREIGN PATENT DOCUMENTS

| | | |
|---|---|---|
| ES | 1071337 | 2/2010 |
| GB | 2163661 | 3/1986 |
| WO | 9503097 | 2/1995 |

OTHER PUBLICATIONS

International Search Report for PCT Application No. PCT/US14/23383; dated Jul. 14, 2014; eleven (11) pages.

*Primary Examiner* — Oren Ginsberg
*Assistant Examiner* — Gary D Urbiel Goldner
(74) *Attorney, Agent, or Firm* — Gerald E. Hespos; Michael J. Porco; Matthew T. Hespos

(57) ABSTRACT

A punching bag and suspension system is a boxing training device that is oriented horizontally, which permits the punching bag to move vertically, horizontally, diagonally, as well as in 360 degree range of motion. The punching bag has a plastic or metal cylindrical tube running through its core. The tube contains an opening on both sides extending to the outer circumference of the punching bag. These openings allow the tube, and therefore the punching bag, to slide along a suspension member. At the center of the suspension member there is a weight that through gravitational pull, creates an orientation and return point for the punching bag.

6 Claims, 5 Drawing Sheets

(56) References Cited

U.S. PATENT DOCUMENTS

| | | | | | |
|---|---|---|---|---|---|
| 4,067,569 | A | * | 1/1978 | Palumbo | 482/48 |
| 4,216,960 | A | * | 8/1980 | Nicholls | 473/430 |
| 4,364,558 | A | | 12/1982 | Aragona | |
| 4,623,146 | A | | 11/1986 | Jackson | |
| 4,632,392 | A | * | 12/1986 | Peyton et al. | 482/110 |
| 4,721,302 | A | | 1/1988 | Murphy | |
| 4,944,513 | A | | 7/1990 | Zentner | |
| 4,948,137 | A | * | 8/1990 | Alvarez | 473/575 |
| 5,011,155 | A | | 4/1991 | Udomkesmalee et al. | |
| 5,286,028 | A | | 2/1994 | Daugard | |
| 5,386,989 | A | * | 2/1995 | Broadway | 473/429 |
| 5,413,347 | A | * | 5/1995 | Prater | 473/147 |
| 5,458,326 | A | | 10/1995 | Marcyes | |
| 6,042,491 | A | | 3/2000 | Dixon, Jr. | |
| 7,033,290 | B1 | * | 4/2006 | Coldren | 473/453 |
| 7,922,595 | B2 | * | 4/2011 | Libonati | 473/224 |
| 7,927,260 | B1 | | 4/2011 | Stalka | |
| 8,118,714 | B2 | * | 2/2012 | Ramsay-Matthews | 482/45 |
| 8,678,982 | B2 | * | 3/2014 | Pellot | 482/83 |
| 8,721,505 | B2 | * | 5/2014 | Conarty | 482/89 |
| 8,777,819 | B1 | * | 7/2014 | Quintana | 482/87 |
| 2002/0169054 | A1 | * | 11/2002 | Schwendemann | 482/87 |
| 2002/0198085 | A1 | | 12/2002 | Wang | |
| 2003/0087733 | A1 | * | 5/2003 | Kim | 482/93 |
| 2004/0110607 | A1 | * | 6/2004 | Crespo | 482/89 |
| 2005/0227825 | A1 | * | 10/2005 | Kutov | 482/83 |
| 2006/0058164 | A1 | * | 3/2006 | Miller et al. | 482/87 |
| 2010/0248908 | A1 | * | 9/2010 | Ramsay-Matthews | 482/89 |
| 2012/0252637 | A1 | | 10/2012 | Pellot | |
| 2012/0309565 | A1 | * | 12/2012 | Ponstein | 473/443 |
| 2013/0065735 | A1 | | 3/2013 | Conarty | |

* cited by examiner

PUNCHING BAG AND SUSPENSION SYSTEM

BACKGROUND

1. Field

The present disclosure relates generally to boxing and exercise apparatuses, and more particularly, to boxing training devices used for offense, defense, and hand/eye coordination drills.

2. Description of the Related Art

Double end punching and exercise bag assemblies have been designed and implemented in gymnasiums and other athletic venues for many decades and generally include an air inflated bag assembly having a variety of spheroidal configurations suspended by two generally vertical cables, one attached to the top of the bag assembly and one attached to the bottom of the bag assembly, attached at their distal ends to generally stationary supports. The attachments stabilize the punching and exercise bag allowing minimal movement of said bag. Generally, punching bags are used for training related to boxing and mixed marital arts, and aid in the development of speed, agility, strength, and punching accuracy associated with these activities.

The principle problem with all of these prior fixed assemblies is that they allow only minimal movement of the punching bag, thus preventing maximum training efficiency.

Therefore, a need exists for a punching bag and suspension system that can complete the above tasks without being restricted to minimal movement and allow for vertical, horizontal, diagonal and a 360-degree range of motion.

SUMMARY

A punching bag and suspension system is provided. The punching bag and suspension system is a boxing training device that moves vertically, horizontally, diagonally, as well as in a 360 degree range of motion. The punching bag and suspension system is used for offense, defense, and hand/eye coordination drills giving the athlete brand-new dynamics in training. Defensively, the punching bag and suspension system is used for assisting the boxer in slipping, blocking, bobbing, weaving, rolling, and creating angles. Furthermore, it helps create advanced footwork. Offensively, the punching bag and suspension system is used for assisting the boxer in jabbing, power punching, speed training, counter punching, combination punching and setups. Furthermore, the punching bag and suspension system creates dynamic angles for more accurate punching. The punching bag and suspension system creates ring generalship through developing awareness, agility, speed, accuracy, and skill level.

The punching bag and suspension system of the present disclosure includes a punching bag supported on a suspension member, where the punching bag is configured to horizontally travel along the suspension member. The suspension member includes first and second ends, where each of the first and second ends include a connection mechanism for connecting the suspension member to stationary objects.

According to an aspect of the present disclosure, the punching bag and suspension system could be located both indoors and outdoors and can be adjusted to any length, for example, between about 4 feet to about 30 feet. The punching bag and suspension system can be positioned between two stationary objects including, but not limited to, a boxing ring, columns, poles, and trees. Both connection mechanisms on either side of the suspension member are connected to the stationary objects. The punching bag may be filled with a gas, soft material, etc, and includes a generally cylindrical tube disposed within and running from one end of the punching bag to the other allowing the suspension member to pass unreservedly through the punching bag. Once the suspension member is secured, the tube of the punching bag travels over the suspension member freely. The suspension member further includes a weight affixed to the center, whereby creating an orientation and return point for the punching bag.

According to one aspect of the present disclosure, an apparatus is provided including a generally spherical punching bag including a tubular member diametrically disposed in the bag; and a suspension member including first and second ends, where each of the first and second ends include a connection mechanism for connecting the suspension member to a stationary object, wherein the punching bag is supported on the suspension member and is configured to horizontally travel along the suspension member.

In one aspect, the tubular member includes a plurality of ball bearing disposed in a wall of the tubular member.

In another aspect, the tubular member includes at least one wheel and coil spring assembly.

In a further aspect, the tubular member further comprises a recoil mechanism configured to return the punching bag to an original position along the suspension member after movement.

In another aspect, the suspension member includes a weight centrally disposed along the length thereof, wherein the weight creates a point that is closer to the ground than any other area on the suspension member directing the punching bag to the center of the suspension member. In one aspect, the tubular member includes a ferromagnetic material and the weight includes a magnetic material to attract the punching bag to the proximity of the weight along the suspension member. In another aspect, the tubular member includes a magnetic material and the weight includes a ferromagnetic material to attract the punching bag to the proximity of the weight along the suspension member.

According to a further aspect of the present disclosure, an apparatus includes at least two spaced apart vertical supports; a suspension member including first and second ends, where each of the first and second ends include a connection mechanism for horizontally supporting the suspension member to the at least two spaced apart vertical supports; and a generally spherical punching bag including a tubular member diametrically disposed in the bag, wherein the punching bag is supported on the suspension member and is configured to horizontally travel along the suspension member and wherein the tubular member further comprises a recoil mechanism configured to return the punching bag to an original position along the suspension member after movement.

According to another aspect of the present disclosure, an apparatus is provided including at least two spaced apart vertical supports; a suspension member including first and second ends, where each of the first and second ends include a connection mechanism for horizontally supporting the suspension member to the at least two spaced apart vertical supports; and a generally spherical punching bag including a tubular member diametrically disposed in the bag, wherein the punching bag is supported on the suspension member and is configured to horizontally travel along the suspension member and wherein the suspension member includes a weight centrally disposed along the length thereof, wherein the weight creates a point that is closer to the ground than any other area on the suspension member directing the punching bag to the center of the suspension member.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Preferred embodiments of the present disclosure will be described hereinbelow with reference to the accompanying drawings. In the following description, well-known functions or constructions are not described in detail to avoid obscuring the present disclosure in unnecessary detail.

Figure 1:
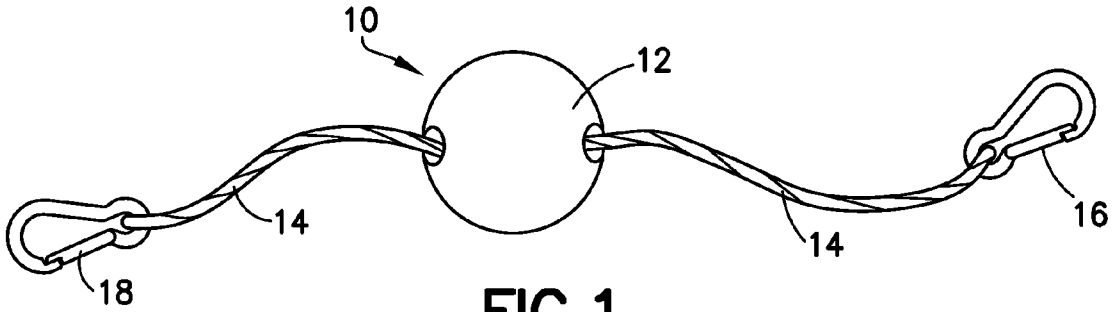
FIG. 1 is a perspective view of the punching bag and suspension system in accordance with an embodiment of the present disclosure.

Referring to the drawings and particularly FIG. 1, a punching bag and suspension system is illustrated and generally designated by the reference character 10. The system includes a punching bag 12 and a suspension member 14. The punching bag 12 may be supported on a generally horizontal suspension member 14 held by a first connection mechanism 16 on one side of the suspension member 14 and a second connection mechanism 18 on the other side of the suspension member 14. In one embodiment, the connection mechanisms 16,18 are self-adjustable to adjust a length of the suspension member 14. The connection mechanisms 16,18 may be latches, hooks, a noose, etc.

Figure 2:
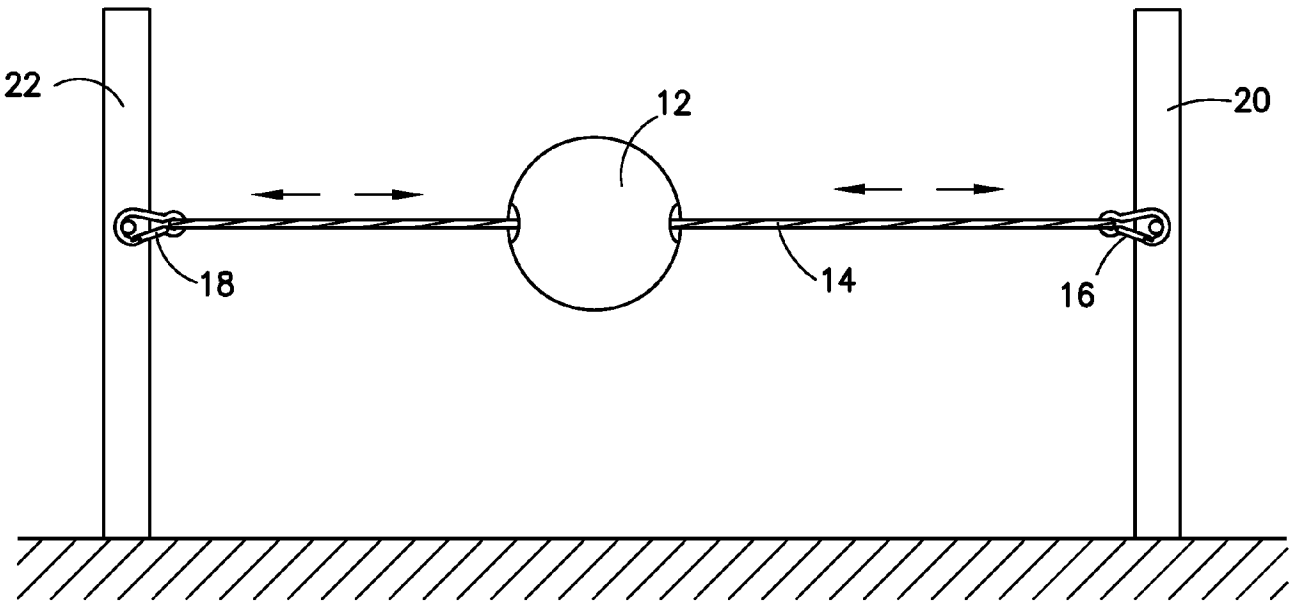
FIG. 2 illustrates a perspective view of the punching bag and suspension system in use in accordance with an embodiment of the present disclosure.

As shown in FIG. 2, the first connection mechanism 16 is attached to a fixed structure 20, e.g., a vertical post or support, and the second connection mechanism 18 is attached to another fixed structure 22, e.g., a vertical post or support, and can be adjustable to any length, for example, between about 4 feet to about 30 feet. When attached to the fixed structures 20, 22, the suspension member 14 is generally horizontal and enables the punching bag 12 to travel horizontally thereon as indicated by the arrows. The punching bag and attachment system 10 may be connected to structures other than structures 20,22 shown in FIG. 2, for example, a wall, a fence, a part of a boxing ring, etc. The punching bag 12 is suspended in the air by the suspension member 14. The suspension member 14 can be made of, but not limited to, a rope, a bungee, a nylon cord, etc. In one embodiment, the suspension member 14 is flexible, e.g., a bungee cord, which increases the movement of the punching bag forward and backward relative to a user in addition to moving side to side.

Figure 3:
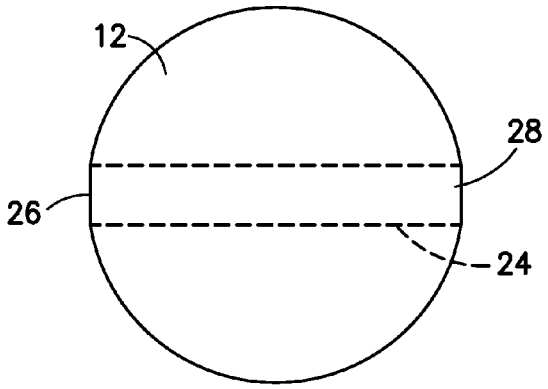
FIG. 3 illustrates a perspective view of the punching bag in accordance with an embodiment of the present disclosure.

As shown in FIG. 3, the punching bag 12 has a cylindrical tube 24 (shown in broken lines) through its core with an opening on one side 26 and an opening on the other side 28. The ends of the cylindrical tube 24 meet the outer circular openings 26,28 of the punching bag 12 flush. These openings 26,28 allow the tube 24 to slide along suspension member 14. The tube 24 may be made of metal, plastic, a magnetic material, a ferromagnetic material, etc.

Figure 4:
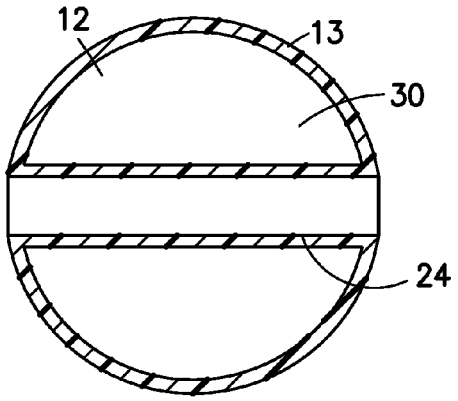
FIG. 4 illustrates a cross-sectional view of the punching bag in accordance with an embodiment of the present disclosure.

As shown in FIG. 4, an outer membrane 13 of the punching bag 12 may include a rubber material, an Ethylene Vinyl Acetate (EVA) material, or an alternate material. The punching bag 12 may include a bladder 30 that could be filled with air, gas, foam, a soft material, etc. In one embodiment, the tube 24 is composed of metal, a ferromagnetic material, plastic, etc. In an alternate embodiment, the tube 24 is magnetized.

Figure 5:
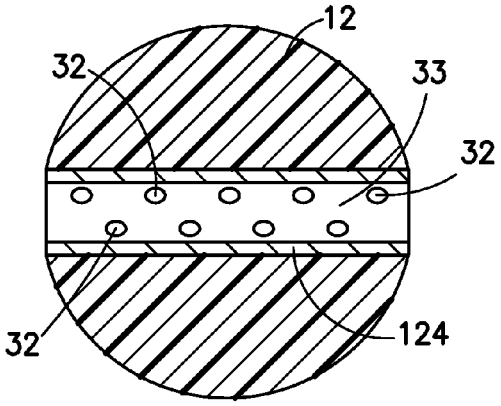
FIG. 5 illustrates a cross-sectional view of the punching bag in accordance with another embodiment of the present disclosure.
Figure 6:
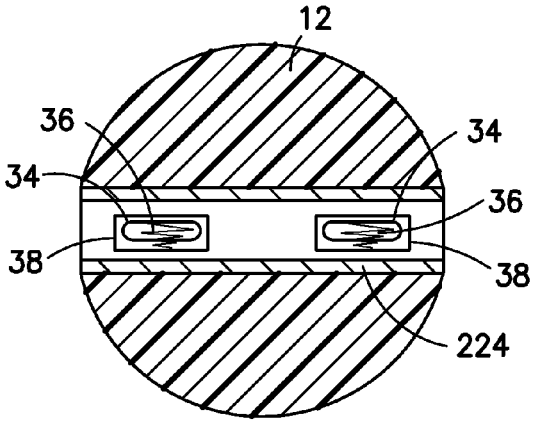
FIG. 6 illustrates a cross-sectional view of the punching bag in accordance with yet another embodiment of the present disclosure.

In yet another alternate embodiment as shown in FIG. 5, the punching bag 12 contains a tube 124 that contains ball bearings 32 in a wall 33 of the tube 124 to help the tube slide easily over the suspension member 14. In a further embodiment as shown in FIG. 6, the tube 224 contains a wheel 34 with an attached coil spring 36 located inside a terminal 38, also known as a recoil mechanism, shown on both ends. When the punching bag 12 is in motion, the wheel 34 contacts the suspension member 14 and winds up the internal coil spring 36 and is eventually propelled back by the coil spring 36 in the opposite direction it was moving, hence bringing it back to its original position. Although the embodiment in FIG. 6 illustrates two wheels 34, coil springs 36, and terminals 38, i.e., two recoil mechanisms, it is to be appreciated that other embodiment may include only one recoil mechanism, two recoil mechanisms or more than two recoil mechanisms.

Figure 7:
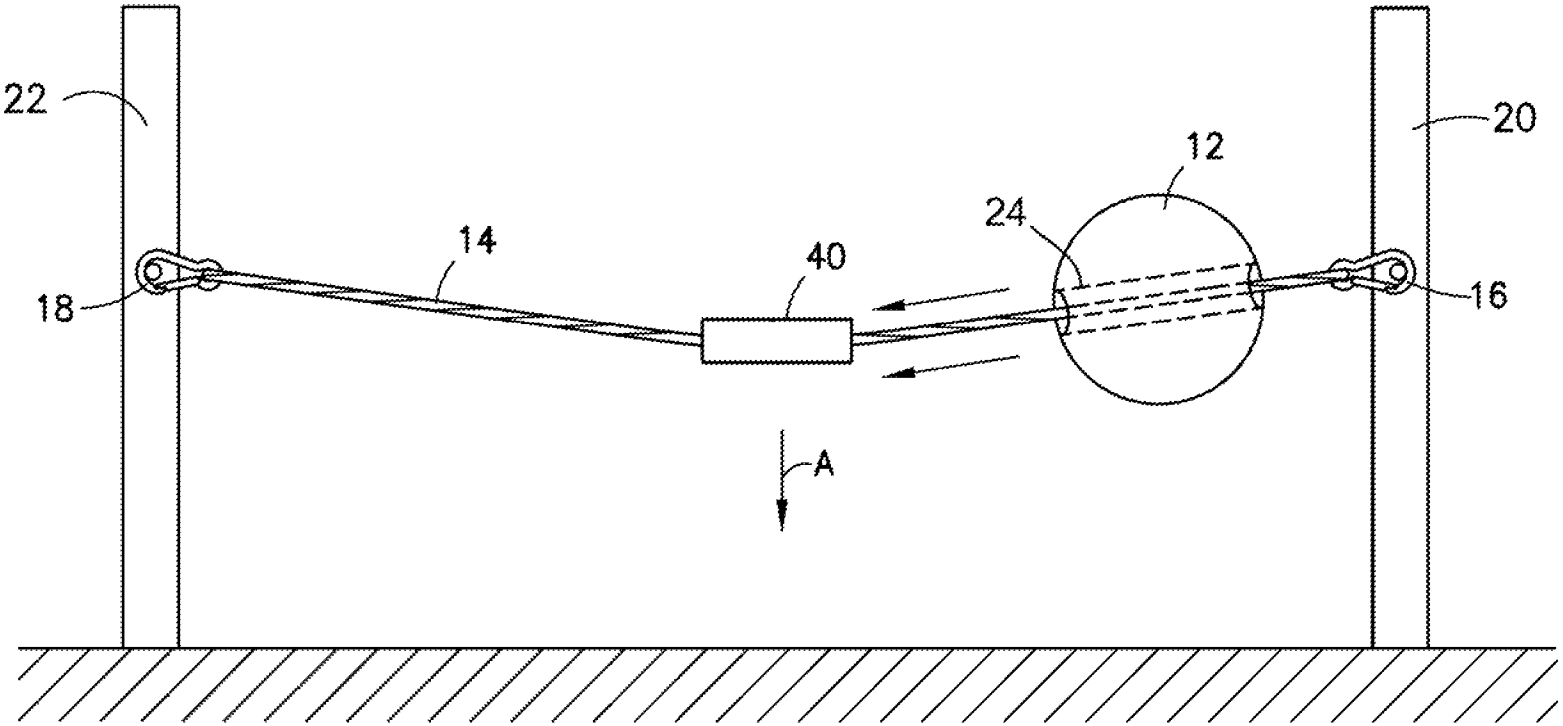
FIG. 7 illustrates a perspective view of the punching bag and suspension system in accordance with an embodiment of the present disclosure.

As shown in FIG. 7, in one embodiment, there is a weight 40 coupled to the suspension member 14 and deposed in the approximate center of the suspension member 14. It is to be appreciated that the weight 40 may be coupled to the suspension member 14 in various ways. For example, the weight 40 may be a sleeve slid over the suspension member 14, the weight may be compressed onto the suspension member 14, the suspension member 14 may be coupled to the ends of the weight 40, etc. It is further to be appreciated that the weight 40 will be configured to allow the tube 24 to travel over the weight 40, e.g., the weight is configured in a generally cylindrical shape.

Due to gravity, the weight 40 creates a point that is closer to the ground than any other area on the suspension member 40 as shown by arrow A, therefore directing the punching bag 12 to the center where the weight 40 is disposed.

In another embodiment, the weight 40 is magnetized and disposed in the approximate center of the suspension member 14 that creates a point that is closer to the ground than any other area as shown by arrow A, therefore directing the punching bag 12 to the center. The magnetism of the weight 40 produces a locking effect when contact is made with the tube 24,124,224 when the tube is made of a predetermined material, e.g., metal, a ferromagnetic material, etc. Since the magnetic weight 40 attracts the tube 24,124,224, the punching bag will tend to come to rest at the weight 40 instead on continuing to travel along the suspension mechanism past the weight 40.

In an alternate embodiment, there is a metal weight 40 in the direct center of the suspension member 14. The weight 40 may be composed of metal or a ferromagnetic material produces a locking effect when contact is made with the magnetized tube 24,124,224 creating an orientation point and return point for the punching bag 12. In yet another embodiment, the tube 24,124,224 could be plastic or an alternate material, and the weight 40 may be made of metal or an alternate material.

Figure 8:
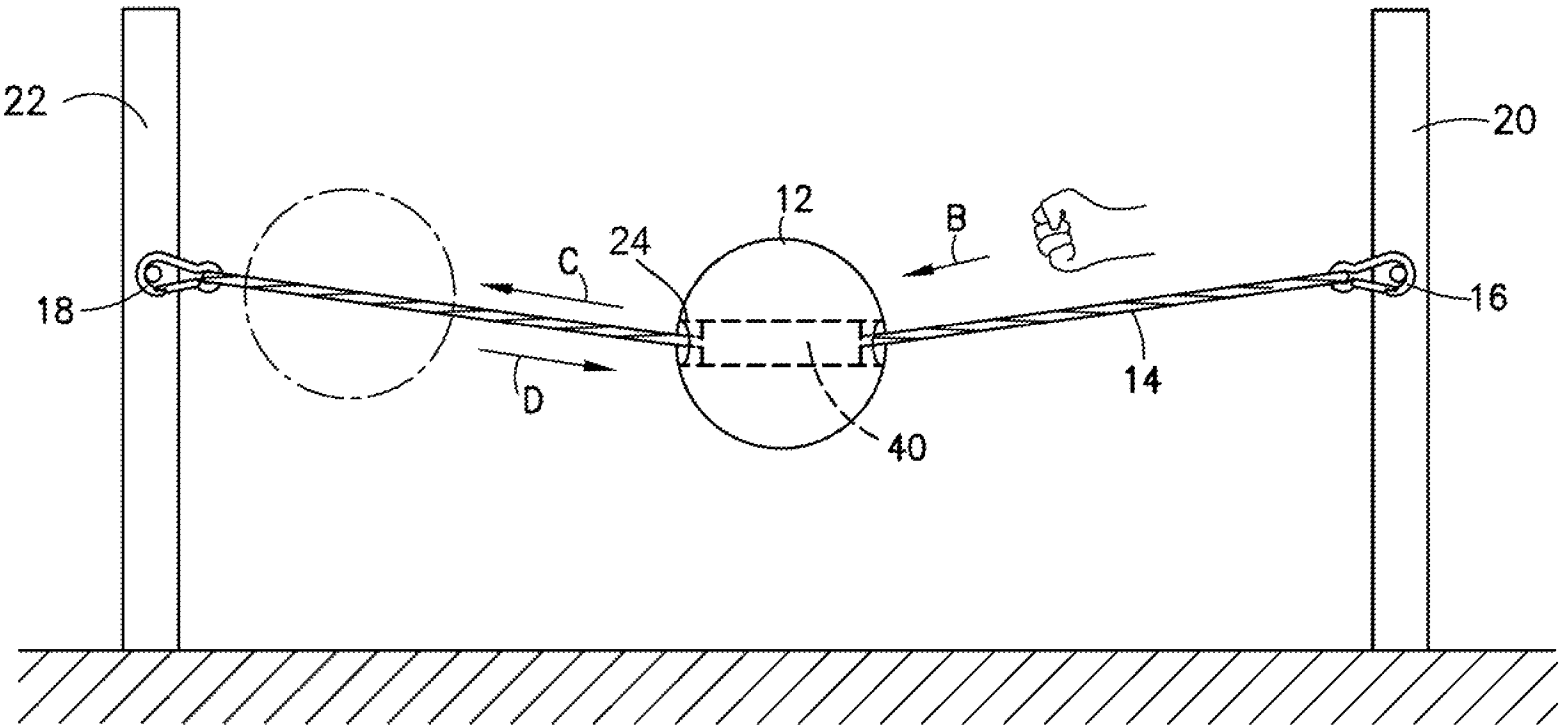
FIG. 8 illustrates a perspective view of the punching bag and suspension system in accordance with another embodiment of the present disclosure.
Figure 9:
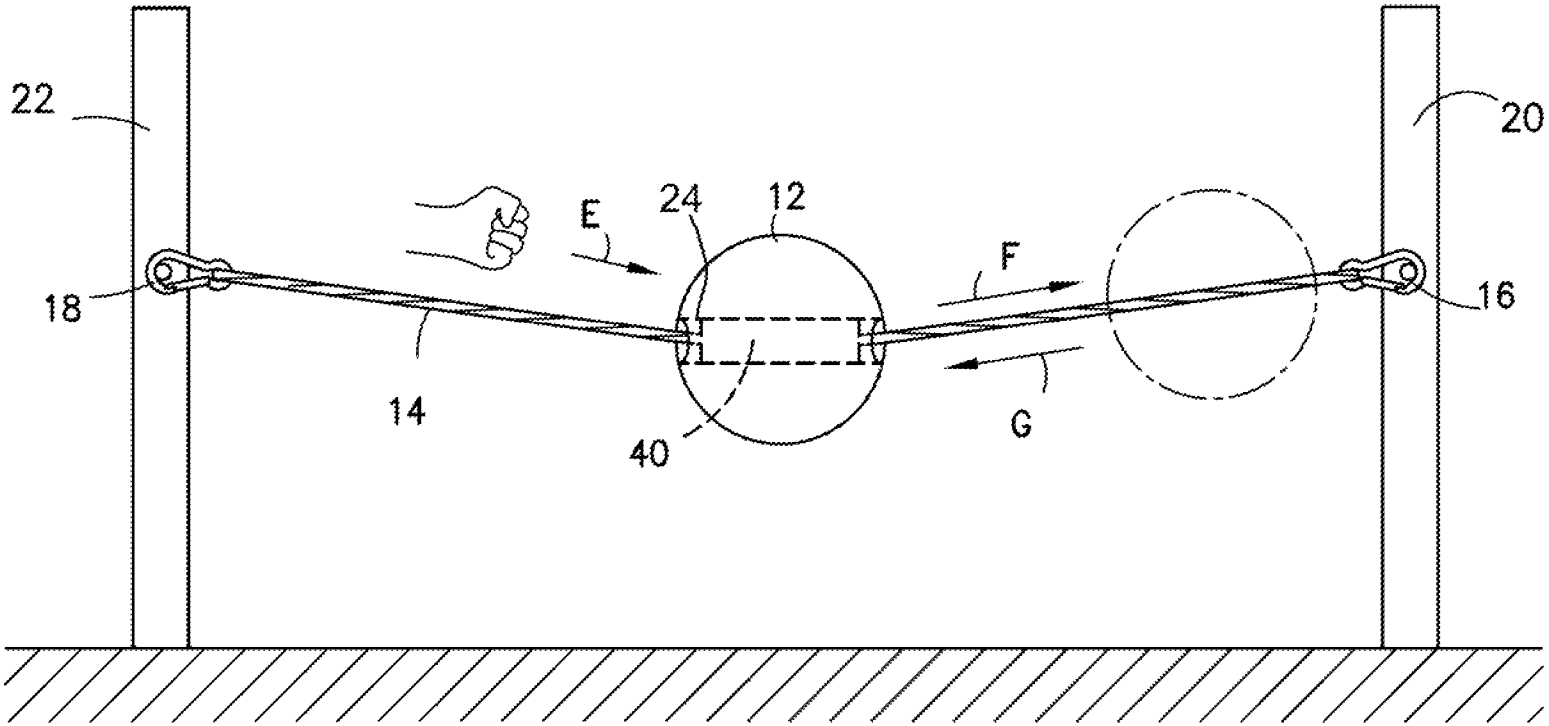
FIG. 9 illustrates a perspective view of the punching bag and suspension system in accordance with yet another embodiment of the present disclosure.

As shown in FIG. 8, when the punching bag 12 is struck on the right side, as shown by arrow B, the punching bag 12 travels along the suspension member 14, as shown by arrow C, until the punching bag 12 comes to rest. Upon rest, the punching bag 12 then returns to its orientation point over the weight 40, as shown by arrow D. As shown in FIG. 9, when the punching bag 12 is struck on the left side, as shown by arrow E, the punching bag 12 travels along the suspension member 14, as indicated by arrow F, until the punching bag 12 comes to rest. Upon rest, the punching bag 12 then returns to its orientation point over the weight 40, as shown by arrow G. In one embodiment, the weight 40 is composed of metal and produces a locking effect when contact is made with the magnetized tube, 24, 124, 224, thus preventing the punching bag 12 from extending past the weight 40. In another embodiment, the tube 24,124,224 is composed of metal and produces a locking effect when contact is made with the magnetized weight 40, thus preventing the punching bag 12 from extending past the weight 40. In yet another embodiment, the tube 24,124,224 could be made of plastic, rubber, a ferromagnetic material, etc. and the weight 40 could be made of a metal, a ferromagnetic material, a non-metal material, etc.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. An apparatus comprising:

a generally spherical punching bag including a tubular member diametrically disposed in the punching bag;

a suspension member including first and second ends, where each of the first and second ends includes a connection mechanism for connecting the first and second ends to a respective stationary object, the punching bag being supported on the suspension member and configured to horizontally travel along the suspension member; and a weight centrally mounted along the length of the suspension member, the weight creating a point on the suspension member that is closer to the ground than any other point on the suspension member thereby directing the punching bag to a central point of the suspension member, wherein the weight is configured to allow the tubular member of the punching bag to travel over the weight.

2. The apparatus as in claim 1, wherein the tubular member includes a ferromagnetic material and the weight includes a magnetic material to attract the punching bag to the proximity of the weight along the suspension member.

3. The apparatus as in claim 1, wherein the tubular member includes a magnetic material and the weight includes a ferromagnetic material to attract the punching bag to the proximity of the weight along the suspension member.

4. An apparatus comprising:

at least two spaced apart vertical supports;

a suspension member including first and second ends, where each of the first and second ends includes a connection mechanism for horizontally supporting the suspension member to the at least two spaced apart vertical supports; and a generally spherical punching bag including a tubular member diametrically disposed in the punching bag, wherein the punching bag is supported on the suspension member and is configured to horizontally travel along the suspension member, and wherein the suspension member includes a weight centrally disposed along the length thereof, wherein the weight creates a point that is closer to the ground than any other area on the suspension member directing the punching bag to the center of the suspension member, the weight being configured to allow the tubular member to travel over the weight.

5. The apparatus as in claim 4, wherein the tubular member includes a ferromagnetic material and the weight includes a magnetic material to attract the punching bag to the proximity of the weight along the suspension member.

6. The apparatus as in claim 4, wherein the tubular member includes a magnetic material and the weight includes a ferromagnetic material to attract the punching bag to the proximity of the weight along the suspension member.

* * * * *